US009518757B2

(12) United States Patent
Boyce

(10) Patent No.: US 9,518,757 B2
(45) Date of Patent: Dec. 13, 2016

(54) AIR RETURN GRILLE ASSEMBLY

(71) Applicant: David James Boyce, Calgary (CA)

(72) Inventor: David James Boyce, Calgary (CA)

( * ) Notice: Subject to any disclaimer, the term of this patent is extended or adjusted under 35 U.S.C. 154(b) by 938 days.

(21) Appl. No.: 13/718,215

(22) Filed: Dec. 18, 2012

(65) Prior Publication Data

US 2014/0170956 A1 Jun. 19, 2014

(51) Int. Cl.
*F24F 13/08* (2006.01)
*F24F 7/00* (2006.01)

(52) U.S. Cl.
CPC ..... *F24F 13/082* (2013.01); *F24F 13/084* (2013.01)

(58) Field of Classification Search
CPC ..... F24F 13/082; F24F 13/084
USPC ..... 454/284, 358, 361–363, 270
See application file for complete search history.

(56) References Cited

U.S. PATENT DOCUMENTS 3,752,055 A * 8/1973 Shuler ..... F24F 13/08 454/332
4,495,857 A * 1/1985 Morgan ..... B60H 1/3407 220/1.5
4,537,119 A * 8/1985 Jarnot ..... F24F 7/00 454/275
5,163,871 A * 11/1992 Huibregtse ..... F24F 13/08 454/289
5,472,380 A * 12/1995 Sarazen, Jr. ..... F24F 13/12 454/290
5,733,191 A * 3/1998 Lam ..... B60H 1/3435 454/284
5,782,051 A * 7/1998 LaVoie ..... F24F 13/08 454/277
5,944,445 A * 8/1999 Montgomery ..... E04B 1/7076 405/87
5,976,009 A * 11/1999 Achen ..... E06B 7/082 454/195
5,984,776 A * 11/1999 Berger ..... F24F 13/085 454/290
6,129,312 A * 10/2000 Weber ..... B64C 1/18 244/118.5
6,289,886 B1 * 9/2001 Radke ..... F24C 15/002 126/307 A
6,302,784 B1 * 10/2001 Berger ..... F24F 13/02 454/289
6,309,297 B1 * 10/2001 Berger ..... F24F 13/085 454/290
6,431,980 B1 * 8/2002 Achen ..... F24F 13/084 454/271
6,506,113 B2 * 1/2003 Berger ..... F24F 13/02 454/290

(Continued)

FOREIGN PATENT DOCUMENTS

GB 2173837 A * 10/1986 ..... E04B 1/644

*Primary Examiner* — Alissa Tompkins
*Assistant Examiner* — Frances F Hamilton
(74) *Attorney, Agent, or Firm* — Kyle R. Satterthwaite; Ryan W. Dupuis; Ade & Company Inc.

(57) ABSTRACT

Provided is air return grille assembly that is to be positioned over the open end of an air return duct. The air return grille assembly comprises a concealing arrangement joined to an air return grille such that it is spaced apart from the rear face of the air return grille. The concealing arrangement obstructs from view, through air flow openings in the air return grille, an air return duct when the air return grille is positioned over the open end of said duct.

9 Claims, 11 Drawing Sheets

(56) References Cited

U.S. PATENT DOCUMENTS

| | | | | |
|---|---|---|---|---|
| 6,814,660 | B1 * | 11/2004 | Cavett | B01D 46/0005 454/284 |
| 6,848,990 | B2 * | 2/2005 | Berger | F24F 13/085 454/290 |
| 7,097,558 | B2 * | 8/2006 | Berger | F24F 13/084 454/289 |
| 7,740,530 | B2 * | 6/2010 | Astourian | F24F 13/082 219/201 |
| 7,789,928 | B2 | 9/2010 | Stepp | |
| 7,794,313 | B2 * | 9/2010 | Ruberg | F24F 13/084 454/284 |
| 8,016,650 | B2 * | 9/2011 | Horstman | B64D 13/00 454/76 |
| 8,156,931 | B2 * | 4/2012 | Jacklich | F23L 17/04 126/299 R |
| 8,419,515 | B1 * | 4/2013 | Dillon | F24F 13/084 454/284 |
| 2002/0022450 | A1 * | 2/2002 | Berger | F24F 13/02 454/290 |
| 2006/0094348 | A1 * | 5/2006 | Berger | F24F 13/084 454/289 |
| 2006/0292978 | A1 * | 12/2006 | Romanuik | F24F 13/082 454/276 |
| 2010/0317277 | A1 * | 12/2010 | Raible | B61D 27/00 454/162 |
| 2011/0124281 | A1 * | 5/2011 | Vagedes | F24F 7/02 454/367 |
| 2012/0031012 | A1 * | 2/2012 | Bonshor | A47J 17/02 52/27 |
| 2012/0160603 | A1 * | 6/2012 | Braybrook | E06B 9/386 181/294 |

* cited by examiner

AIR RETURN GRILLE ASSEMBLY

FIELD

This disclosure relates to the field of heating and ventilation duct covers, and in particular to air return grille grilles or air return grill assemblies.

BACKGROUND

Air return ducts for heating or air conditioning systems, frequently referred to as cold air returns, are commonly located in a visible area of the floor, wall, or ceiling of a building. These air return ducts are typically covered by a cover or grille that improves the aesthetics of the duct and prevents large objects from entering the air return duct, while allowing air to flow through the duct.

Generally air return grilles comprise a single grille that can be mounted to a wall, floor, or ceiling so as to be positioned over the open end of an air return duct. This grille comprises openings that allow air to flow through the grille and into the air return duct. These grille openings are often large enough that the air return duct behind the grille is visible to a person looking at the grille, particularly in Victorian or antique style grilles where the openings are formed in a manner where the remaining material separating the openings from one another forms an ornamental pattern or design.

Various air return grille assemblies have been described. For example, U.S. Pat. No. 7,789,928 and US2007266685 disclose air duct end filter assemblies, where a frame disposed behind the main grille is used to support an air filter behind the grille, but the frame is perforated to allow airflow through it, and thus would not provide any vent-concealing functionality if used without the filter. Further, air return grilles comprising air diffuser screens supported behind the grille are available, such as those sold by Classic Grills in Valley Center, Calif., www.classicgrills.com, but the perforated screen structure of the diffuser results in openings through which an observer can see the air duct.

Grilles for air supply ducts feeding air into a room, as opposed to return air ducts receiving re-circulating air back to the furnace or air-conditioner, typically employ a damper system for opening and closing the end of the duct at which the grill is mounted. While the closed damper may obscure the grille openings, it is undesirable to provide a damper on a cold-air return grille, as unintentional closing of the damper may starve the heating/cooling system of sufficient air circulation.

Accordingly, there remains a desire for a solution for air duct concealment for ornamental air return grilles.

SUMMARY

The present disclosure provides an air return grille assembly for mounting over the open end of an air return duct to obscure the air return duct from view. The air return grille assembly may further prevent large objects from entering the air return duct, while allowing sufficient airflow into the air return duct to meet the needs of the heating or air conditioning system supplied by the air return duct. The disclosure further provides an air return grille assembly, comprising an air return grille and an air return duct concealing arrangement that, when the air return grille assembly is mounted over the open end of an air return duct, blocks from view through air flow openings in the face of the air return grille the open end of the air return duct over which the air return grille assembly is mounted.

The present disclosure provides an air return grille assembly for mounting over an open end of an air return duct, the air return grille assembly comprising a grille comprising a front face, a rear face, and at least one opening for airflow through said grille; and a concealing arrangement joined to the grille and residing in a fixed, stationary position spaced apart from the rear face of the grille and spanning an area of the grille in which the at least one opening is defined; wherein the concealing arrangement is arranged to obstruct from view, through the at least one opening, an air return duct when the air return grille is positioned over the open end of said duct. The air return grille assembly may further prevent large objects from entering the air return duct, while allowing sufficient airflow into the air return duct to meet the airflow needs of the heating or air conditioning system supplied by the air return duct.

In an embodiment, the concealing arrangement comprises at least one concealing plate that is joined to the rear face of the grille through distinct and separate connections between the concealing plate and the grille at spaced apart locations around the perimeter of the concealing plate.

In a further embodiment, the grille comprises at least one boss protruding from its rear face.

In an embodiment, the at least one boss is integral with the grille.

In an additional embodiment the concealing arrangement is joined to the rear face of the grille through attachment to at least one of the at least one boss.

In a further embodiment, the concealing arrangement is attached to at least one of the at least one boss by a threaded fastener.

In an embodiment, the air return grille assembly comprises a plurality of bosses protruding from the rear face of the grille to support the concealing arrangement, the bosses being spaced apart to allow air to flow through the at least one opening in the grille, around the concealing arrangement, and into the air return duct when the grille assembly is positioned over the open end of said air return duct.

In an additional embodiment, the air return grille assembly comprises a plurality of bosses protruding from the rear face of the grille that are distributed adjacent to the perimeter of the concealing arrangement, for support thereof, such that the majority of the perimeter of the concealing arrangement, is open to allow air flow around the concealing arrangement, when the grille assembly is positioned over the open end of the air return duct.

In an embodiment, the air return grille assembly comprises mounting bosses located proximal to the perimeter of the grille and projecting from the rear face thereof past the concealing arrangement, outside the perimeter thereof, respective wall mounts separate from the grille and arranged to mount on a wall surrounding the open end of the air return deduct, and a magnetic catch mechanism operable to magnetically attract the mounting bosses and wall mounts together for magnetic mounting of the grille to the wall.

In an embodiment, the concealing arrangement, is arranged to be positioned over the open end of the air return duct when the air return grille assembly is mounted over the open end of the air return duct.

In a further embodiment, the air return grille comprises a frame that projects rearward from the rear face of the grille and extends past the concealing plate, for placement of the frame against a surface from which the air return duct opens in order to situate the grille and concealing arrangement, over and outside the surface of the air return duct. In an embodiment, the frame is integral with the grille.

In an embodiment, the concealing arrangement comprises at least one substantially solid plate. In a further embodiment, the concealing arrangement consists of a concealing plate having an unperforated solid portion spanning an area of the grille in which the at least one opening is defined, such that the unperforated solid portion of the concealing plate obstructs from view, through the at least one opening, the air return duct when the air return grille is positioned over the open end of said duct.

In an embodiment, the concealing arrangement is smaller in area than the grille.

The disclosure further provides an air return grille for mounting over an open end of an air return duct, the air return grille comprising: a front face, a rear face, at least one opening for airflow through said grille, and at least one boss projecting from the rear face of the grille, wherein the boss is arranged for fastening of an air duct concealing arrangement to the rear face of the grille.

In an embodiment, the at least one boss is integral with the rear face of the grille.

In a further embodiment, the air return grille comprises a plurality of bosses protruding from the rear face of the grille that are spaced apart to allow air to flow through the at least one opening in the grille, around the air duct concealing arrangement, and into an air return duct when the air duct concealing arrangement is fastened to the rear face of the grille and the air return grille is mounted over the open end of the air return duct.

In an additional embodiment, the air return grille comprises comprising a plurality of bosses protruding from the rear face of the grille that are distributed proximal to the perimeter of the grille, such that when the air duct concealing arrangement is fastened to the rear face of the grille and the air return grille is mounted over the open end of the air return duct, the majority of the perimeter of the concealing arrangement is open to allow air flow through the at least one opening in the grille, around the air duct concealing arrangement, and into the air return duct.

In an embodiment, the air return grille comprising a frame that projects rearward from the rear face of the grille and extends past the at least one boss, for placement of the frame against a surface from which the air return duct opens in order to situate the air return grille over and outside the surface of the air return duct. In a further embodiment, the frame is integral with the grille.

According to another aspect of the invention, there is provided an air return grille assembly for mounting over an open end of an air return duct, the air return grille assembly comprising:

(a) a grille comprising an outer perimeter, a front face, a rear face, a plurality of openings passing through the front and rear faces for airflow through said grille, and an unperforated periphery portion residing adjacent the outer perimeter of the grille and spanning around an opening-equipped area in which the plurality of openings are located;

(b) a concealing arrangement joined to the grille and residing in a fixed, stationary position spaced apart from the rear face and fully spanning the opening-equipped area of the grille;

(c) a plurality bosses through which the concealing arrangement is supported on the grille, said plurality of bosses extending between the concealing arrangement and the unperforated periphery portion of the grille at spaced apart positions around an outer perimeter of the concealing arrangement;

(d) a frame comprising a plurality of frame walls projecting from the rear face of the grille at the outer perimeter thereof, the frame walls reaching extending past the concealing arrangement at positions spaced outwardly from the outer perimeter thereof, with distal ends of the frame walls residing in a common plane for abutment of said distal ends of said frame walls against a wall surface around the open end of the air return duct, said plurality of fame walls being perpendicular to said common plane;

(e) open airflow spaces situated between the plurality of bosses around the outer perimeter of the concealing arrangement and arranged to enable airflow around said concealing arrangement and onward through the air return duct;

wherein the concealing arrangement is arranged to obstruct from view, through the plurality of openings, the air return duct when the air return grille is positioned over the open end of said duct, while the plurality of bosses are hidden behind the unperforated periphery portion of the grille.

In an installed position on a wall of a building at which the open end of said return air duct opens into a room of said building and communicates air from said room into a heating and/or air conditioning system of said building, the distal ends of the frame walls abut against said wall of the building around the open end of the return air duct and the concealing arrangement resides over the open end of the air return duct.

In one embodiment, the openings in the grille are arranged in an ornamental pattern, and include openings of greater size than the bosses through which the concealment arrangement is supported.

In one embodiment, the distal end of each frame wall resides entirely within the common plane, and abuts the wall surface over a full length of said frame wall in the installed position.

In one embodiment, the outer perimeter of the grille is rectangular and the plurality of frame walls comprises two parallel frame walls residing at opposing sides of the rectangular outer perimeter of the grille.

In one embodiment, the plurality of frame walls comprises a third frame wall joining together said two parallel frame walls along a third side of the rectangular outer perimeter of the grille.

In one embodiment, a fourth side of the rectangular outer perimeter of the grille is unoccupied by a respective frame wall.

In another embodiment, the plurality of frame walls comprises a fourth frame wall joining together said two parallel frame walls along a fourth side of the rectangular outer perimeter of the grille.

DESCRIPTION

Figure 1:
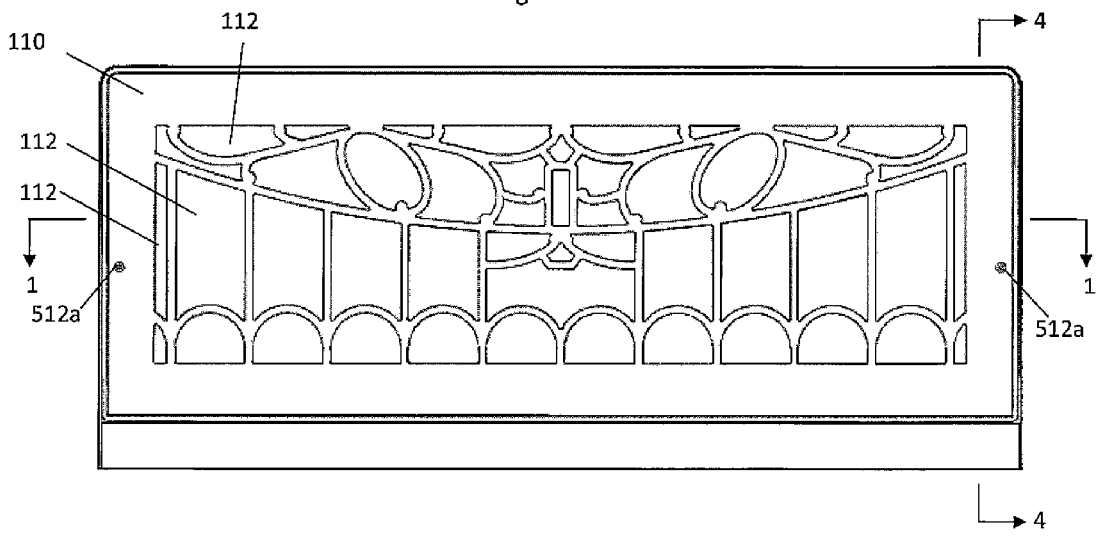
FIG. 1 is a front plan view of an embodiment of an air return grille.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense. Further, where considered appropriate, reference numerals may be repeated among the figures to indicate corresponding or analogous elements.

The present disclosure provides generally an air return grille and an air return grille assembly for mounting over the open end of an air return duct or other opening where air flow is desired. The air return grille assembly comprises an air return grille and a concealing plate mounted in a fixed, stationary position behind the air return grille that obstructs from view the air return duct over which the air return grille assembly is mounted, while allowing air to flow through the grille, past the concealing plate, and into the air return duct.

FIG. 1 depicts a front plan view of an embodiment of an air return grille 114. The grille comprises a front face 110 comprising a plurality of air flow openings 112. The air flow openings 112 may be of any size or combination of sizes, shape or combination of shapes, design, and arrangement that allows sufficient air flow through the grille to meet the air flow requirements for the air return duct over which the air return grille is to be mounted. Further, the grille may be of any size, shape, and configuration that is sufficient to fully cover the open end of an air return duct. For example, the grille may be square, rectangular, round, oblong, hexagonal, or any other geometric shape and the face of the grille may be curved, flat, or undulate.

Figure 2:
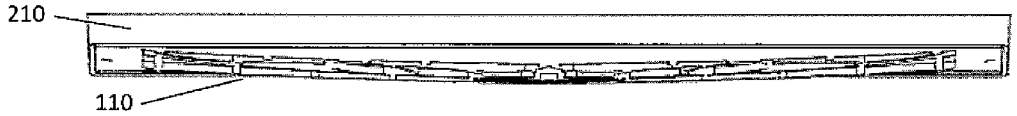
FIG. 2 is a top plan view of the air return grille of FIG. 1.
Figure 3:
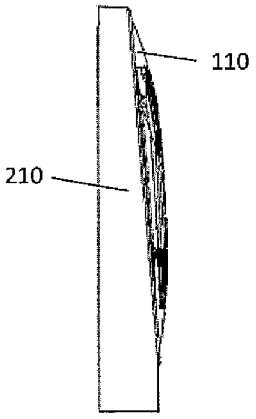
FIG. 3 is a left plan view of the air return grille of FIG. 1.
Figure 4:
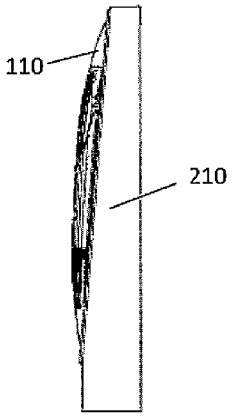
FIG. 4 is a right plan view of the air return grille of FIG. 1.

FIG. 2 depicts a top plan view of the air return grille of FIG. 1, while FIGS. 3 and 4 depict left and right plan views, respectively, of the air return grille of FIG. 1. The grille comprises a frame 210 that extends along the sides and top portion of the grille to provide depth, allowing the front face 110 of the grille to be spaced apart from the open end of the air return duct over which the air return grille is to be mounted. In the illustrated embodiment, the frame is integral with the grille and extends along the sides and top portion of the grille, but not along the bottom portion of the grille. In other non-illustrated embodiments, the frame may be joined to, but not integral with, the edges or rear face of the grille. Further, the frame may extend around one or more sections of the periphery of the grille or the frame may extend around the entire periphery of the grille.

Figure 5:
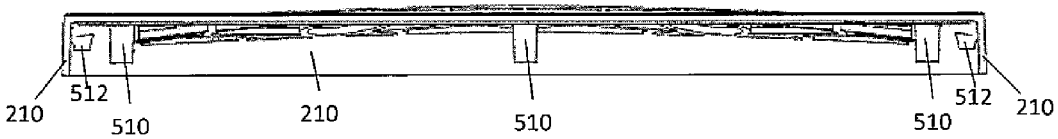
FIG. 5 is a bottom plan view of the air return grille of FIG. 1.

FIG. 5 depicts a bottom plan view of the air return grille of FIG. 1. The top portion of frame 210 is visible behind concealing plate mounting bosses 510 and air return grille mounting bosses 512.

Figure 6:
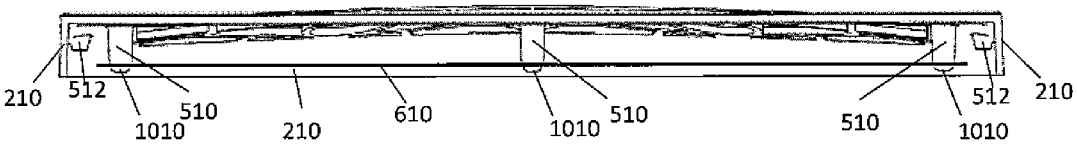
FIG. 6 is a bottom plan view of an embodiment of an air return grille assembly.

FIG. 6 depicts a bottom plan view of an air return grille assembly comprising the air return grille of FIG. 1 joined to an air duct concealing plate 610. The top portion of frame 210 is visible behind concealing plate mounting bosses 510 and air return grille mounting bosses 512. The air duct concealing plate 610 is joined to concealing plate mounting bosses 510 by threaded fasteners 1010. In other non-illustrated embodiments, the concealing plate may be spaced apart from and joined to the rear face of the grille in other fashions as will be understood by a person skilled in the art. For example, the concealing plate may instead be adhered or welded to the bosses or protrusions that project from the rear face of the grille, or the concealing plate may be joined to the rear face of the grille by one or more brackets or frames of a form other than integrally formed bosses.

In another embodiment, the bosses or protrusions for joining the grille and concealing plate may be formed integrally with the concealing plate rather than with the grille. However, the illustrated embodiment presents advantage where threaded fasteners are used, as the fasteners are threaded into the grille-mounted bosses from behind the grille, without passing therethrough, thereby keeping the fasteners entirely hidden from sight from the front side of the grille. In some embodiments, the frame 210 is of sufficient depth so that when the air return grille assembly is mounted over the open end of an air return duct, the concealing plate 610 is positioned in front of, and not within, the open end of the air return duct.

Figure 7:
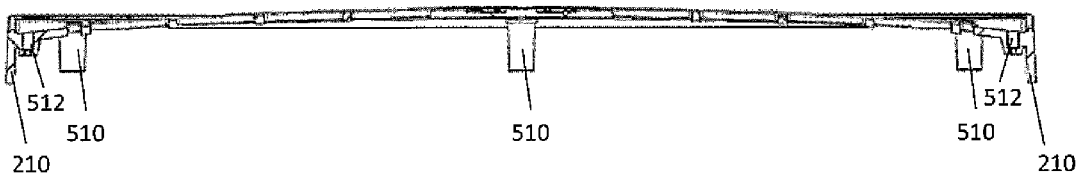
FIG. 7 is a sectional view of the air return grille of FIG. 1, taken at the sectioning plane and in the direction indicated by section lines 1-1.

FIG. 7 depicts a sectional view of the air return grille of FIG. 1, taken at the sectioning plane and in the direction indicated by section lines 1-1, illustrating the concealing plate mounting bosses 510, air return grille mounting bosses 512, and a cross-section of frame 210.

Figure 8:
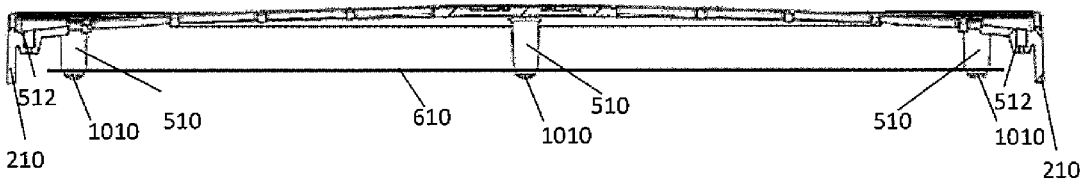
FIG. 8 is a sectional view of the air return grille assembly of FIG. 6, taken at the sectioning plane and in the direction indicated by section lines 1-1 in FIG. 1.

FIG. 8 depicts a sectional view of the air return grille assembly of FIG. 6, taken at the sectioning plane and in the direction indicated by section lines 1-1 as shown in FIG. 1, illustrating the air duct concealing plate 610 which is joined to the concealing plate mounting bosses 510 by fasteners 1010, the air return grille mounting bosses 512, and a cross-section of frame 210.

Figure 9:
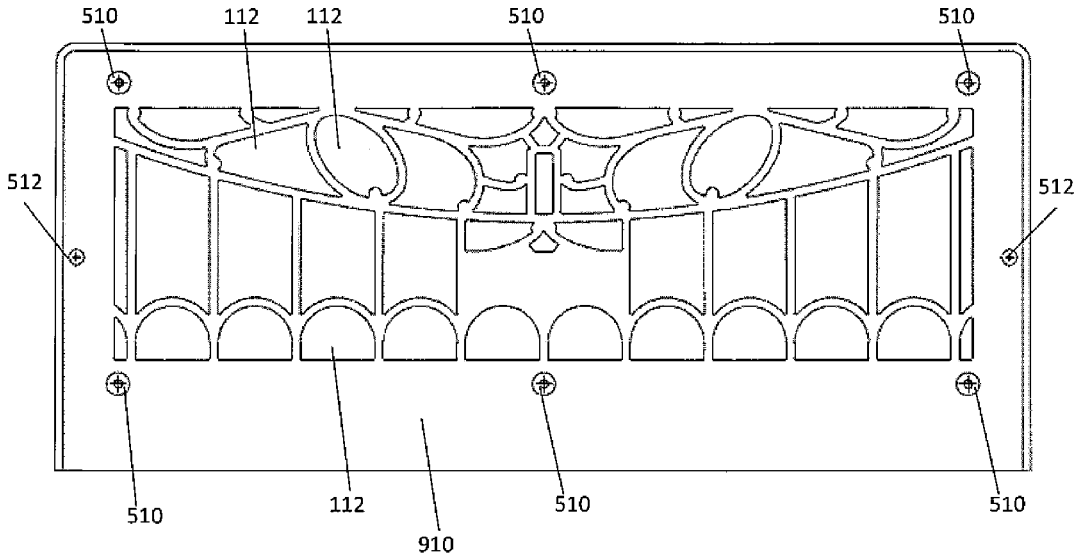
FIG. 9 is a rear plan view of the air return grille of FIG. 1.

FIG. 9 depicts a rear plan view of the air return grille of FIG. 1, illustrating the rear face of the grille 910 comprising air flow openings 112, concealing plate mounting bosses 510, and air return grille mounting bosses 512. In this embodiment, a plurality of concealing plate mounting bosses 510 are distributed around the periphery of the portion of the grille that comprises the air flow openings 112. However, a single concealing plate mounting boss may be employed. Further, the concealing plate mounting bosses may be joined to any portion of the rear face of the grille, so long as there is adequate open space between the concealing plate mounting bosses to allow air to flow through the air flow openings 112, around a duct concealing plate 610 joined to said one or more concealing plate mounting bosses 510, and into the open end of an air return duct when the air return grille assembly is mounted over the open end of the air return duct.

The concealing plate has an area slightly exceeding that of the air flow opening-equipped portion of the grille, and holes in the concealing plate for accommodating the threaded fasteners are situated just a short distance inward from the perimeter edges of the concealing plate to align with the concealing plate mounting bosses. The grille mounting bosses 512 are situated further outward from the opening-featuring portion of the grille than the concealing plate mounting bosses 510 so as to reside outside the perimeter of the installed concealing plate. The internal bores 512*a* of the grille mounting bosses 512 pass through the grille to the front face thereof as shown in FIGS. 1 and 13, so that additional threaded fasteners (not shown) can be passed through these bosses from the front face of the grill to reach past the concealing plate and frame to engage the grille to the wall surface surrounding the opening of the air duct.

Figure 10:
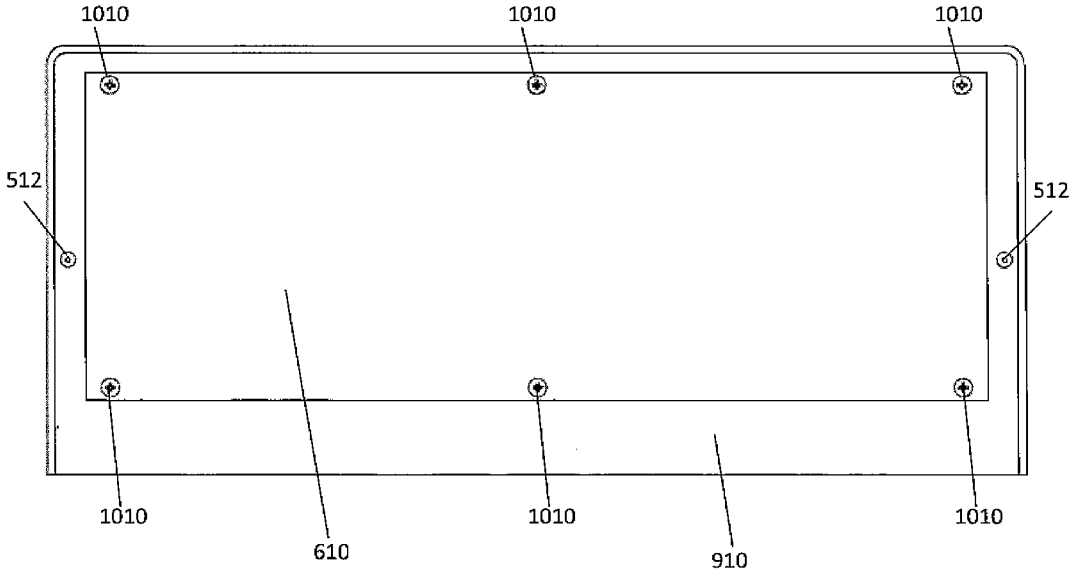
FIG. 10 is a rear plan view of the air return grille assembly of FIG. 6.

FIG. 10 depicts a rear plan view of the air return grille assembly of FIG. 6, illustrating air duct concealing plate 610 joined to the air return grille of FIG. 1 by threaded fasteners 1010 and further illustrating air return grille mounting bosses 512.

Figure 11:
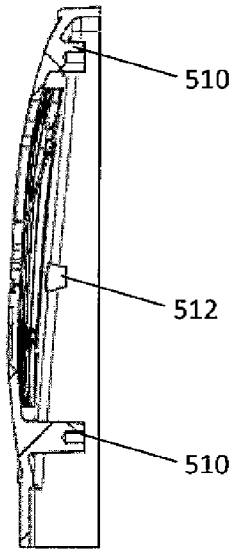
FIG. 11 is a side sectional view of the air return grille of FIG. 1, taken at the sectioning plane and in the direction indicated by section lines 4-4.
Figure 12:
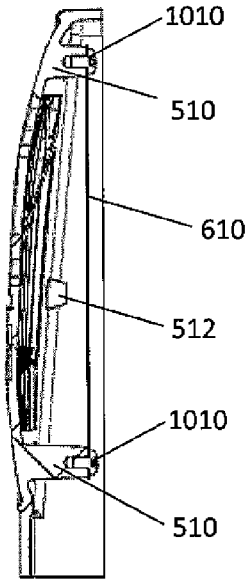
FIG. 12 is a side sectional view of the air return grille assembly of FIG. 6, taken at the sectioning plane and in the direction indicated by section lines 4-4 in FIG. 1.

FIGS. 11 and 12 depict sectional views of the air return grille of FIG. 1 and the air return grille assembly of FIG. 6, respectively, taken at the sectioning plane and in the direction indicated by section lines 4-4 in FIG. 1.

Figure 13:
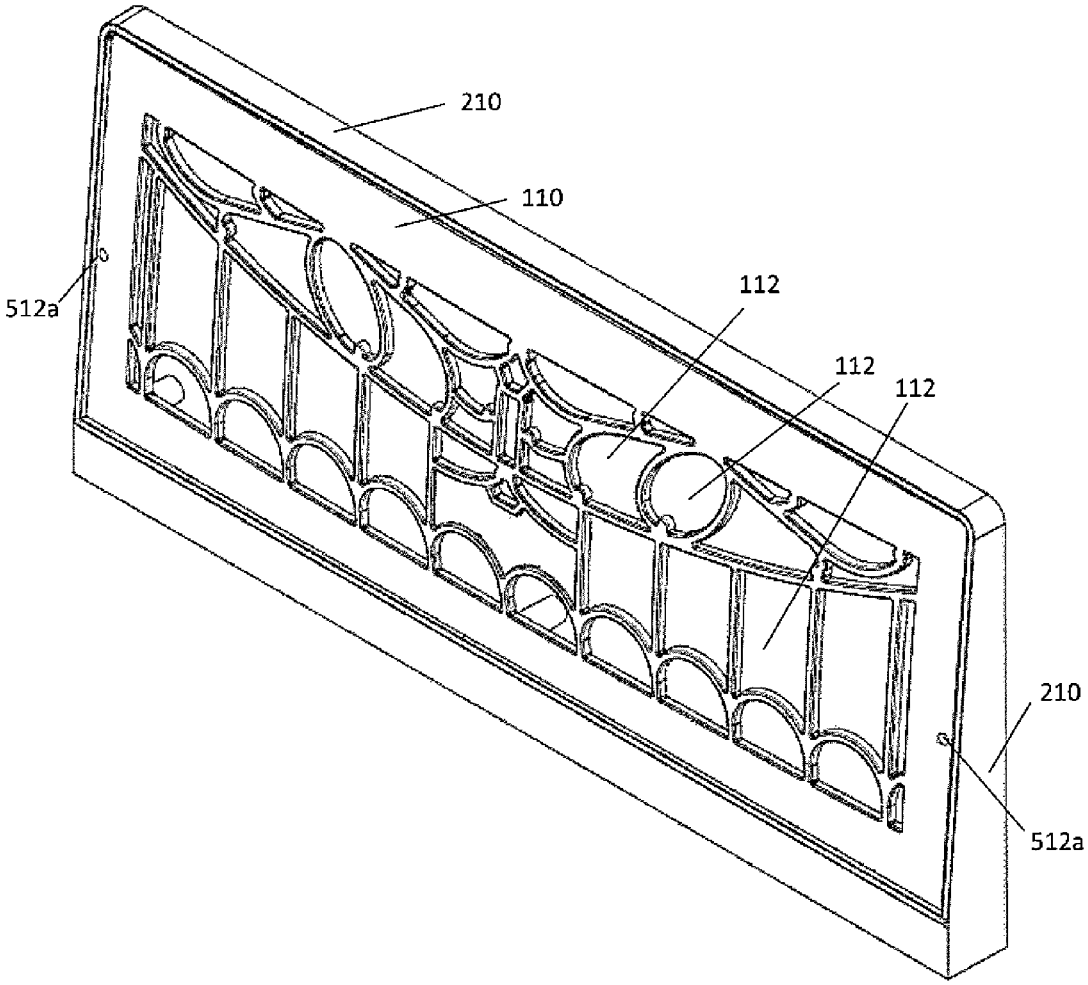
FIG. 13 is a front perspective view of the air return grille of FIG. 1.

FIG. 13 depicts a front perspective view of the air return grille of FIG. 1.

Figure 14:
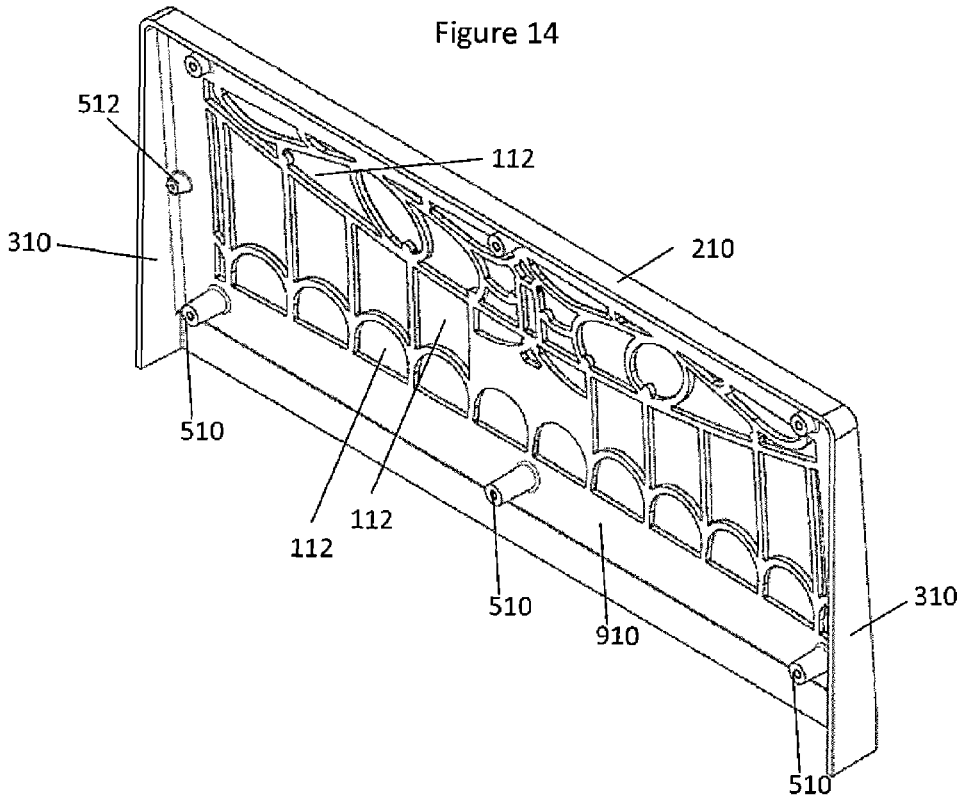
FIG. 14 is a rear perspective view of the air return grille of FIG. 1.

FIG. 14 depicts a rear perspective view of the air return grille of FIG. 1.

Figure 15:
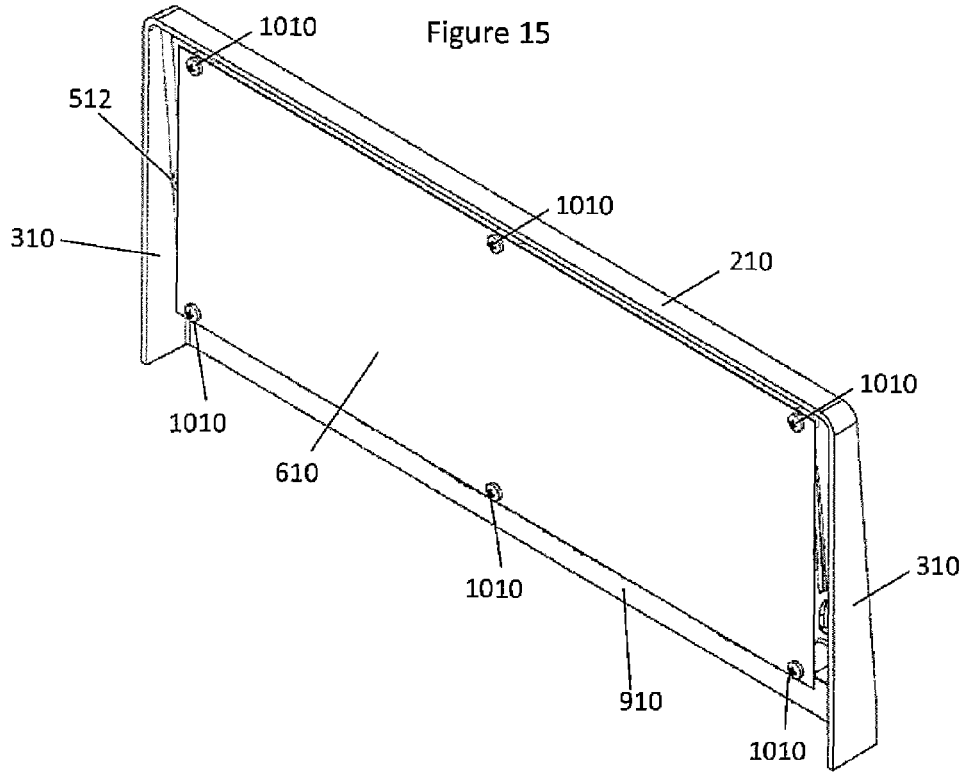
FIG. 15 is a rear perspective view of the air return grille assembly of FIG. 6.

FIG. 15 depicts a rear perspective view of the air return grille assembly of FIG. 6.

Figure 16:
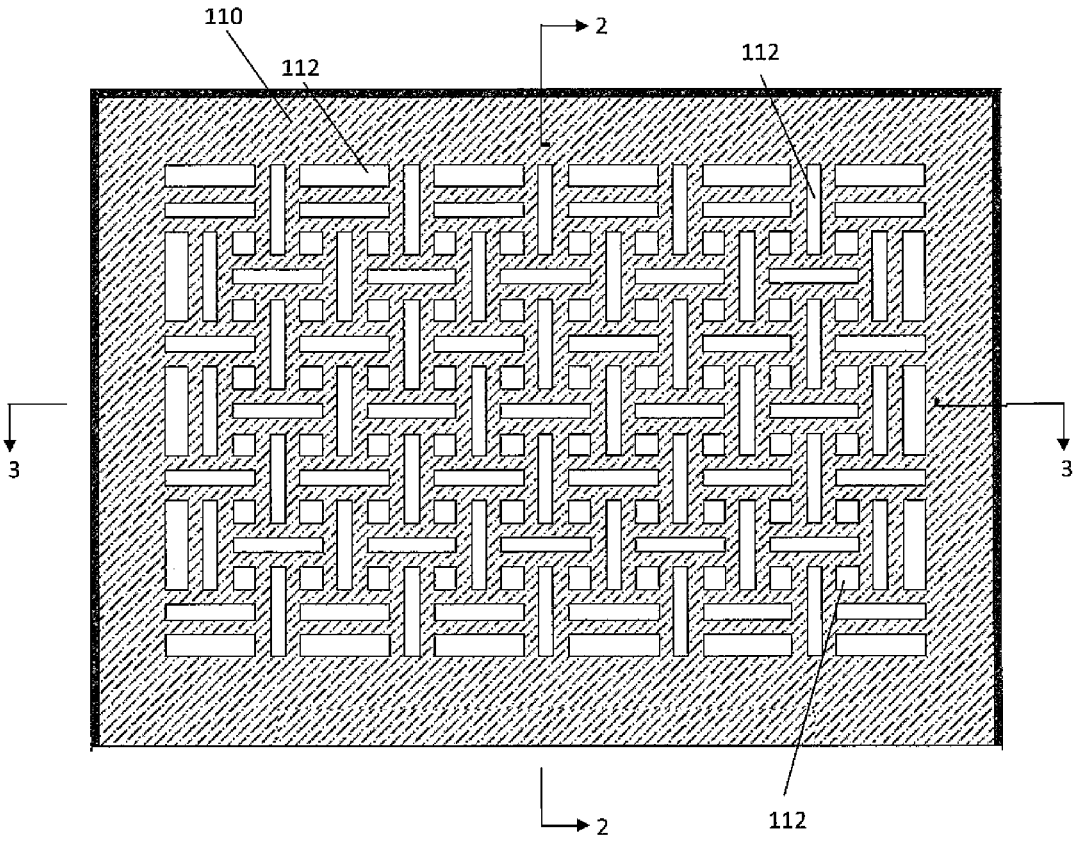
FIG. 16 is a front plan view of a second embodiment of an air return grille assembly.

FIG. 16 depicts a front plan view of a second embodiment of an air return grille assembly. The front face 110 of the air return grille comprises a plurality of air flow openings 112.

Figure 17:
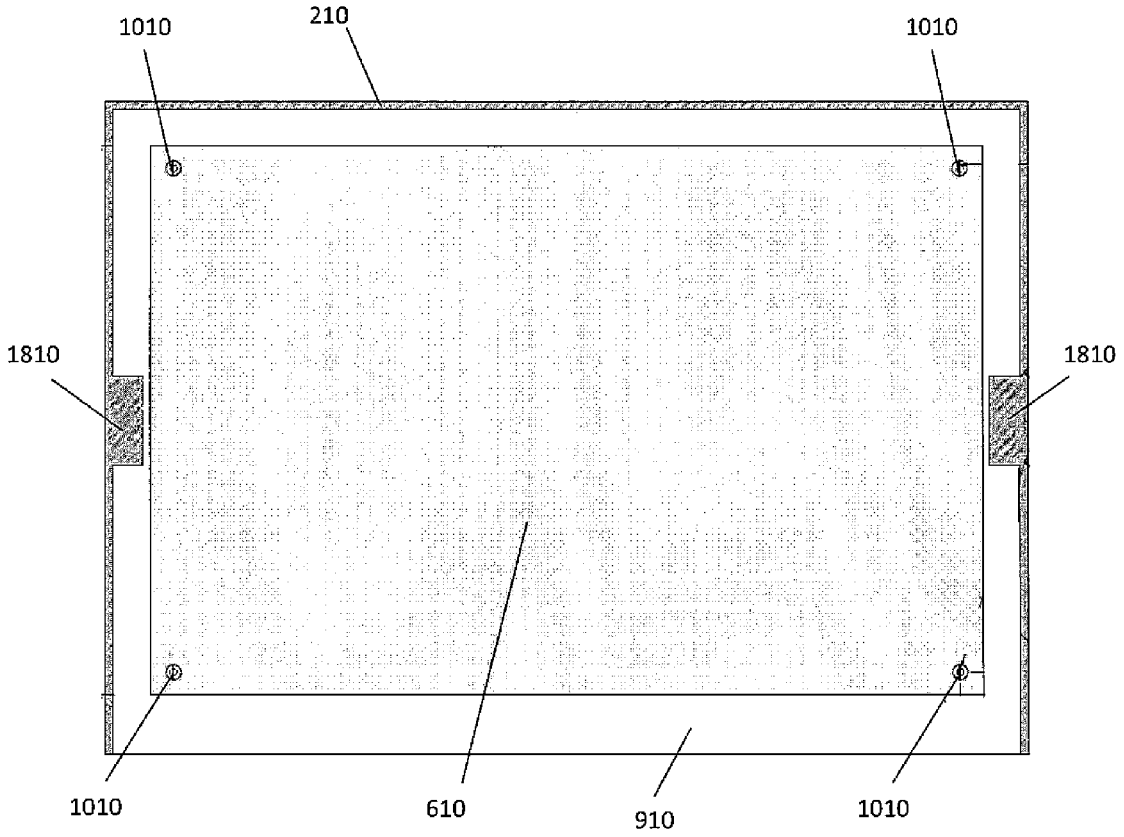
FIG. 17 is a rear plan view of the air return grille assembly of FIG. 16.

FIG. 17 depicts a rear plan view of the air return grille assembly of FIG. 16. The rear face of the grille 910 is joined to grille mounting bosses 1810 that abut the grille frame 210. These bosses project from the rear face of the grille 910 beyond air duct concealing plate 610, which is joined to the grille by fasteners 1010 to reside in a fixed stationary position parallel to the rear face of the grille, allowing the air return grille assembly to be mounted over an open end of an air return duct such that the air duct concealing plate is in front of, and not within, the open end of the air return duct.

Figure 18:
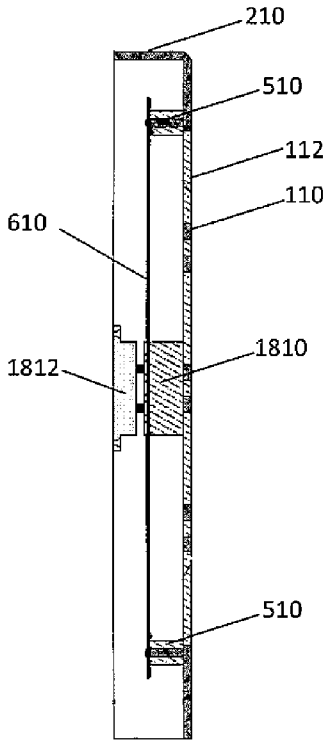
FIG. 18 is a sectional view of the air return grille assembly of FIG. 16, taken at the sectioning plane and in the direction indicated by section lines 2-2.

FIG. 18 depicts a sectional view of the air return grille assembly of FIG. 16, taken at the sectioning plane and in the direction indicated by section lines 2-2. Visible are grille frame 210, a cross-section of the front face of the grille 110, air flow openings 112, air return grille mounting boss 1810, and magnetic catch 1812, which can be mounted to a wall surface adjacent to the open end of the air return duct. The air return duct concealing plate 610 is joined to concealing plate mounting bosses 510.

Figure 19:
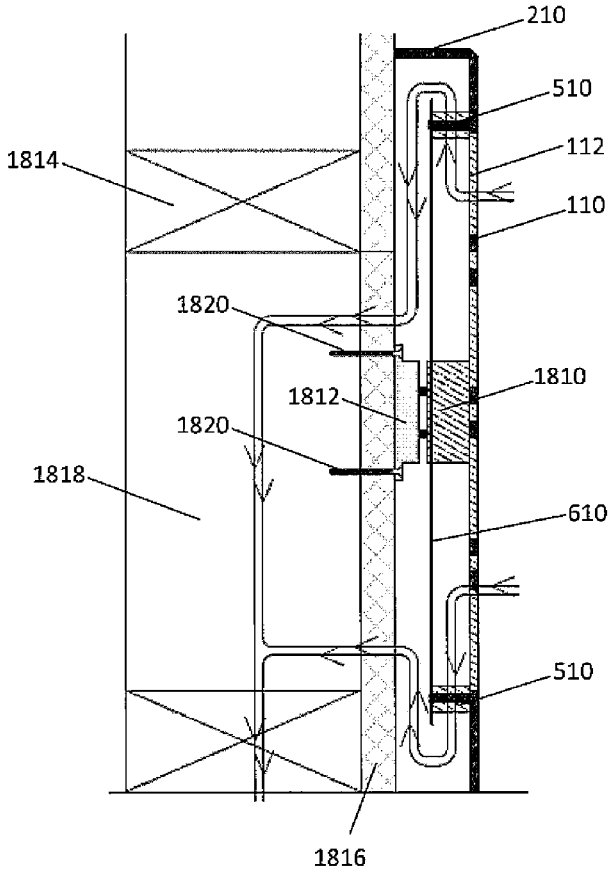
FIG. 19 is a sectional view of the air return grille assembly of FIG. 16 mounted over the open end of an air return duct, taken at the sectioning plane and in the direction indicated by section lines 2-2.

FIG. 19 depicts a sectional view of the air return grille assembly of FIG. 16 mounted over the open end of an air return duct, taken at the sectioning plane and in the direction indicated by section lines 2-2. The air return grille assembly is mounted against a wall surface 1816 and held in place by a magnetic catch 1812 that is fastened to the wall surface by fasteners 1820 and engages metal air return grille mounting boss 1810. The air return grille assembly covers the open end of air return duct 1818, which may be abutted by wall framing members 1814. The arrows indicate the flow of air through the air flow openings 112 in the air return grille, past the concealing plate mounting bosses 510, around concealing plate 610, and into the air return duct 1818.

Figure 20:
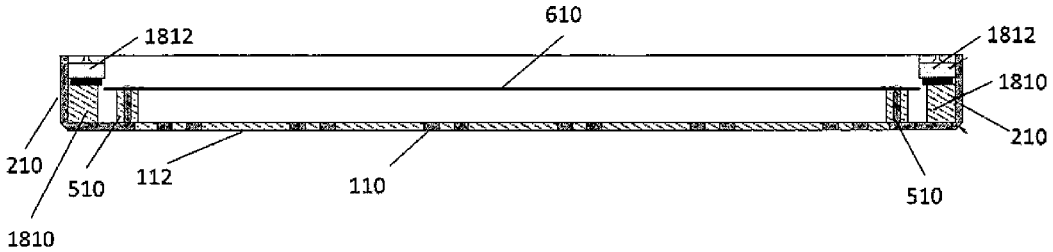
FIG. 20 is a sectional view of the air return grille assembly of FIG. 16, taken at the sectioning plane and in the direction indicated by section lines 3-3.

FIG. 20 depicts a sectional view of the air return grille assembly of FIG. 16, taken at the sectioning plane and in the direction indicated by section lines 3-3. The air return grille assembly comprises metal mounting bosses 1810 that are arranged to engage magnetic catches 1812 that are mounted to a surface adjacent to the open end of the air return duct, over which the air return grille assembly is mounted.

Figure 21:
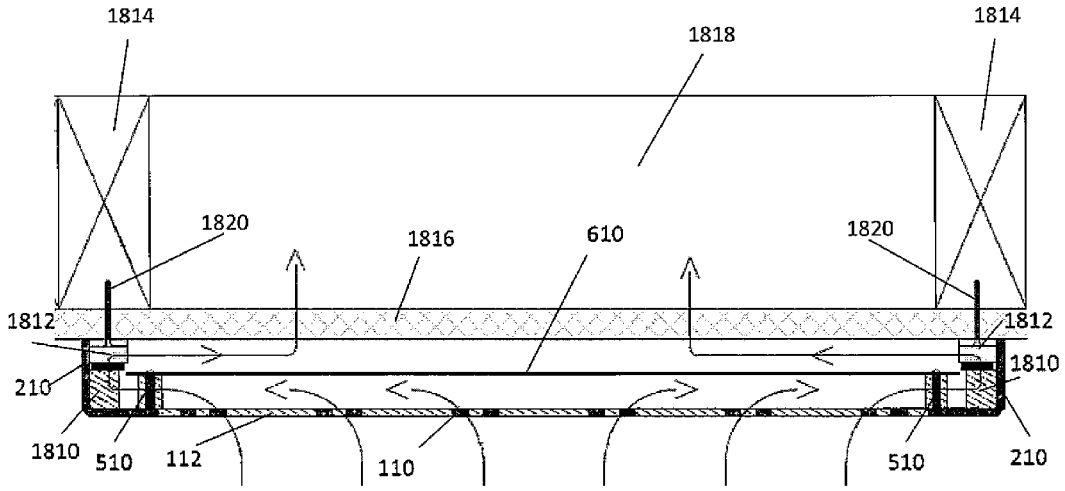
FIG. 21 is a sectional view of the air return grille assembly of FIG. 16 mounted over the open end of an air return duct, taken at the sectioning plane and in the direction indicated by section lines 3-3.

FIG. 21 depicts a sectional view of the air return grille assembly of FIG. 16 mounted over the open end of an air return duct, taken at the sectioning plane and in the direction indicated by section lines 3-3. The air return grille assembly is mounted against a wall surface 1816 through engagement between metal bosses 1810 joined to the rear face of the grille and magnetic catches 1812 that are joined to the wall by fasteners 1820 that pass through the wall surface 1816, and for example into wall framing members 1814. The arrows indicate the flow of air through the air flow openings 112 in the air return grille, past the concealing plate mounting bosses 510, around concealing plate 610, and into the air return duct 1818.

The magnetic catches of the second embodiment avoid the need for passage of fasteners through the front face of the grille to secure the grille to the wall, and also allow easy removal and reinstallation of the grille without having to disengage any fasteners from the wall, for example for cleaning or painting purposes. The magnetic catch mechanism may employ magnets on the wall mounted pieces to attract ferromagnetic metal components on the grille, as in the illustrated embodiment, or the reverse configuration, where the magnets are carried on the grille to attract to ferromagnetic wall-mounted pieces or ferromagnetic elements on wall mounted pieces of other material composition.

Figure 22:
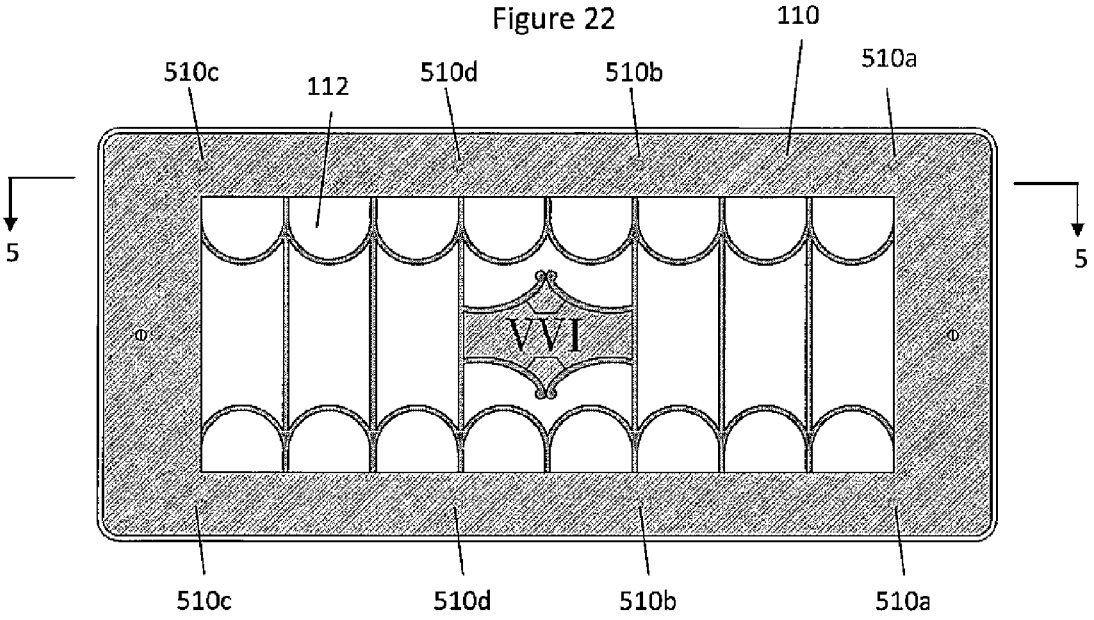
FIG. 22 is a front plan view of a third embodiment of an air return grille assembly of the present invention.
Figure 23:
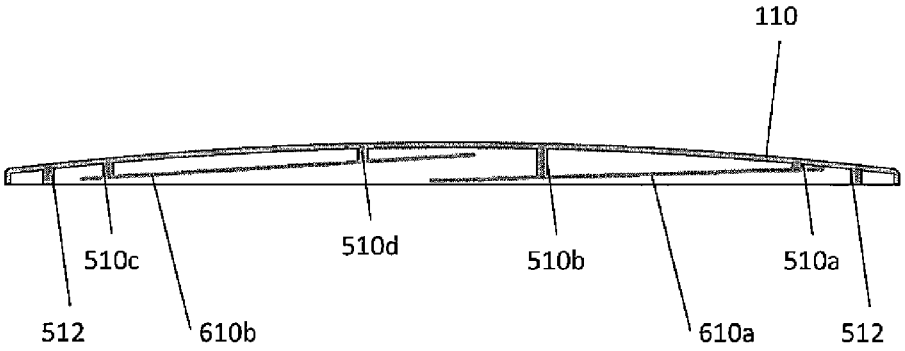
FIG. 23 is a sectional view of the air return grille assembly of FIG. 22, taken at the sectioning plane and in the direction indicated by section lines 5-5.

FIGS. 22 and 23 depict a third embodiment of an air return grille assembly. The front face 110 of the air return grille comprises a plurality of air flow openings 112. The assembly differs from the preceding embodiments primarily in that a pair of overlapping concealment plates 610*a*, 610*b* are used in place of the single concealment plate of the previous embodiments, thereby demonstrating that the device or arrangement mounted to the grille for concealing the ductwork from sight need not necessarily have the form of a single unitary plate, and also that the path of airflow past the concealment device need not necessarily be limited strictly to airflow around the perimeter of the arrangement at locations outside the opening-equipped grille area of the grille.

The third embodiment uses two planar concealment plates that lie in different respective planes, each angularly offset from the plane bound the distal ends of the frame walls 210 that project from the rear face of the grille around the perimeter thereof. Unlike the other embodiments, the frame 210 of the third embodiment has four such walls, one at each and every side of the rectangular perimeter of the grille. This embodiment thus may be used for covering the open end of a ceiling or floor duct, whereas the preceding embodiments lack a frame wall on one side for particular use with in-wall ducts, where the open bottom side of the grille assembly is concealed from sight by placement atop the floor.

In the illustrated embodiment, the two concealment 610*a*, 610*b* plates overlap one another in the longer lengthwise dimension of the grille's elongated rectangular shape, each spanning partially across the corresponding lengthwise dimension of the rectangular area of the grille in which the airflow openings 112 are formed. Each concealment plate 610*a*, 610*b* spans the full widthwise dimension of this hole-equipped area of the grille.

So as to angularly offset the plane of a first one of the concealment plates 610*a* from the other 610*b*, the first concealment plate 610 is mounted on the grille by a pair of outer plate mounting bosses 510*a* disposed on opposite sides of the opening-equipped area of the grille adjacent the respective end of this area, and a pair of inner plate mounting bosses 510*b* disposed on opposite sides of this area near a lengthwise center thereof. The inner bosses 510*b* are longer than the outer bosses 510*a* so as to reach further toward the plane of the distal ends of the frame walls 210 than the shorter outer bosses 510*a*, whereby the first concealment plate slopes toward this plane moving toward the lengthwise center of the opening-equipped area of the grille.

The second concealment plate 610*b* is also supported by a pair of outer bosses 510*c* disposed on opposite sides of the opening-equipped grille area near a respective end thereof and a pair of inner bosses 510*d* disposed on opposite sides of the opening-equipped grille area near the lengthwise center thereof. The two inner pairs of bosses 510*b*, 510*d* are positioned symmetrically across a central plane that cuts centrally through the grille in the width direction to mark the lengthwise center of the grille. The inner bosses 510*d* for mounting the second plate 610*b* are shorter than the inner bosses 510*b* of the first plate 610*a*, whereby an inner end of the second plate overlaps the inner end of the first plate in the space between the first plate 610*a* and the grille. These inner ends of the two plates each extend past the lengthwise center of the opening-equipped grille area to achieve this overlap at the center of the grille.

In the illustrated two-plate embodiment, the grille is curved in the lengthwise direction to present a convex front face 110 and concave rear face, and the two pairs of bosses 510*c*, 510*d* supporting the second concealment plate 610*b* are of equal or similar width, causing the second plate 610*b* to slope toward the grille, away from the plane of the distal frame wall ends, in the direction moving inwardly over the grille-area toward the lengthwise center thereof. The difference in length between the two pairs of mounting bosses for the first concealment plate 610*a* doesn't match the slope of the curved grille between the boss positions, hence the first concealment plate also being sloped relative to the plane of the frame defined by the distal ends of the frame walls.

The overlapping plates collectively provide the same sight-obstructing effect as the single plate of the other illustrated embodiments in order to block viewing of the ductwork through the openings of the grille, while a gap left between the two plates 610*a*, 610*b* at the overlapping inner ends thereof increases the available space by which air can flow past the overall ductwork-concealing structure.

It will be appreciated that multi-plate embodiments having more than two overlapping plates may be used, and that overlapping plates need not necessarily be angularly offset from one another or from the plane bound by the distal ends of the frame walls. That is, another embodiment may have two parallel plates that overlap one another, preferably in a manner spaced apart in the frame depth dimension in which the frame walls extend to allow airflow through the resulting gap between the overlapping ends of the plates, and each of the parallel plates may be parallel or non-parallel with the plane that is bound by the distal ends of the frame walls.

The grilles of the present invention may be produced using known casting techniques to form the grille and all mounting bosses as integral parts of the same overall unitary structure, thereby providing for simple final assembly by fastening of one or more flat concealment plates to the casted single piece.

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments.

Further, while the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting. It will be understood by persons skilled in the art that other variants and modifications may be made without departing from the scope of the invention as defined in the appended claims.

What is claimed is:

1. An air return grille assembly for mounting over an open end of an air return duct, the air return grille assembly comprising:

(a) a grille comprising an outer perimeter, a front face, a rear face, a plurality of openings passing through the front and rear faces for airflow through said grille, and an unperforated periphery portion residing adjacent the outer perimeter of the grille and spanning around an opening-equipped area in which the plurality of openings are located;

(b) a concealing arrangement joined to the grille and residing in a fixed, stationary position spaced apart from the rear face and fully spanning the opening-equipped area of the grille;

(c) a plurality of bosses through which the concealing arrangement is supported on the grille, said plurality of bosses extending between the concealing arrangement and the unperforated periphery portion of the grille at spaced apart positions around an outer perimeter of the concealing arrangement; and (d) a frame comprising a plurality of frame walls projectinq from the rear face of the grille at the outer perimeter thereof, the frame walls reaching and extending past the concealing arrangement at positions spaced outwardly from the outer perimeter thereof, with distal ends of the frame walls residing in a common plane for abutment of said distal ends of said frame walls against a wall surface around the open end of the air return duct, said plurality of fame walls being perpendicular to said common plane;

(e) open airflow spaces situated between the plurality of bosses around the outer perimeter of the concealing arrangement and arranged to enable airflow around said concealing arrangement and onward through the air return duct;

wherein the concealing arrangement obstructs from view, through the plurality of openings, the air return duct when the air return grille is positioned over the open end of said duct, while the plurality of bosses are hidden behind the unperforated periphery portion of the grille.

2. The air return grille assembly of claim 1, in combination with the return air duct and a wall of a building at which the open end of said return air duct opens into a room of said building and communicates air from said room into a heating and/or air conditioning system of said building, wherein the air return grille assembly resides in an installed position with the distal ends of the frame walls abutted against said wall of the building around the open end of the return air duct and the concealing arrangement residing over the open end of the air return duct.

3. The air return grille assembly of claim 1 wherein the plurality of openings in the grille are arranged in an ornamental pattern, and include openings of greater size than the bosses through which the concealment arrangement is supported.

4. The air return grille assembly of claim 1 wherein the distal end of each frame wall resides entirely within the common plane.

5. The air return grille assembly of claim 2 wherein the distal end of each frame wall of the grille assembly abuts the wall surface over a full length of said frame wall of the grille assembly.

6. The return air grille assembly of claim 1 wherein the outer perimeter of the grille is rectangular and the plurality of frame walls comprises two parallel frame walls residing at opposing sides of the rectangular outer perimeter of the grille.

7. The return air grille assembly of claim 6 wherein the plurality of frame walls comprises a third frame wall joining together said two parallel frame walls along a third side of the rectangular outer perimeter of the grille.

8. The return air grille assembly of claim 7 wherein a fourth side of the rectangular outer perimeter of the grille is unoccupied by a respective frame wall.

9. The return air grille assembly of claim 7 wherein the plurality of frame walls comprises a fourth frame wall joining together said two parallel frame walls along a fourth side of the rectangular outer perimeter of the grille.

* * * * *